US007537051B1

(12) United States Patent
Hall et al.

(10) Patent No.: US 7,537,051 B1
(45) Date of Patent: May 26, 2009

(54) DOWNHOLE POWER GENERATION ASSEMBLY

(76) Inventors: David R. Hall, 2185 S. Larsen Pkwy., Provo, UT (US) 84606; Scott Dahlgren, 2185 S. Larsen Pkwy., Provo, UT (US) 84606; Jonathan Marshall, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/021,565

(22) Filed: Jan. 29, 2008

(51) Int. Cl.
*E21B 43/00* (2006.01)

(52) U.S. Cl. ..... 166/65.1; 166/66.5; 340/854.4

(58) Field of Classification Search ..... 166/65.1, 166/66.5; 340/853.7, 853.4, 854.5
See application file for complete search history.

(56) References Cited

U.S. PATENT DOCUMENTS

| | | | | |
|---|---|---|---|---|
| 2,414,719 | A | 1/1947 | Clood | |
| 3,867,655 | A | 2/1975 | Stengel | |
| 3,967,201 | A | 6/1976 | Rorden | |
| 4,416,494 | A | 11/1983 | Watkins | |
| 4,564,068 | A * | 1/1986 | Baugh | 166/123 |
| 4,720,640 | A | 1/1988 | Anderson | |
| 4,785,247 | A | 11/1988 | Meador | |
| 4,806,928 | A | 2/1989 | Veneruso | |
| 5,337,002 | A | 8/1994 | Mercer | |
| 5,803,193 | A | 9/1998 | Krueger | |
| 5,839,508 | A | 11/1998 | Tubel | |
| 5,965,964 | A | 10/1999 | Skinner | |
| 6,223,826 | B1 | 5/2001 | Chau | |
| 6,253,847 | B1 | 7/2001 | Stephenson | |
| 6,367,564 | B1 | 4/2002 | Mills | |
| 6,392,317 | B1 | 5/2002 | Hall | |
| 6,446,728 | B2 | 9/2002 | Chau | |
| 6,651,755 | B1 | 11/2003 | Kelpe | |
| 6,655,464 | B2 | 12/2003 | Chau | |
| 6,670,880 | B1 | 12/2003 | Hall | |
| 6,717,501 | B2 | 4/2004 | Hall | |
| 6,739,413 | B2 | 5/2004 | Sharp | |
| 6,799,632 | B2 | 10/2004 | Hall | |
| 6,821,147 | B1 | 11/2004 | Hall | |
| 6,830,467 | B2 | 12/2004 | Hall | |
| 6,844,498 | B2 | 1/2005 | Hall | |
| 6,845,822 | B2 | 1/2005 | Chau | |
| 6,848,503 | B2 | 2/2005 | Schultz | |
| 6,888,473 | B1 | 5/2005 | Hall | |
| 6,913,093 | B2 | 7/2005 | Hall | |
| 6,929,493 | B2 | 8/2005 | Hall | |
| 6,945,802 | B2 | 9/2005 | Hall | |
| 6,968,611 | B2 | 11/2005 | Hall | |
| 7,028,779 | B2 | 4/2006 | Chau | |
| 7,133,325 | B2 * | 11/2006 | Kotsonis et al. | 367/83 |
| 7,150,329 | B2 | 12/2006 | Chau | |
| 7,190,084 | B2 | 3/2007 | Hall | |
| 7,193,526 | B2 | 3/2007 | Hall | |
| 2004/0104797 | A1 | 6/2004 | Hall | |
| 2004/0113808 | A1 | 6/2004 | Hall | |

(Continued)

*Primary Examiner*—Giovanna C Wright
(74) *Attorney, Agent, or Firm*—Tyson J. Wilde

(57) ABSTRACT

In one aspect of the invention, a downhole power generation assembly has a downhole tool string component comprising a bore. A collar is rotatably supported within the bore and has a centralized fluid passageway and a plurality of turbine blades. The collar is connected to a power generation element such that rotation of the collar moves the power generation element and induces an electrical current.

19 Claims, 8 Drawing Sheets

U.S. PATENT DOCUMENTS

2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall
2005/0001735 A1 1/2005 Hall
2005/0001736 A1 1/2005 Hall
2005/0001738 A1 1/2005 Hall
2005/0024231 A1* 2/2005 Fincher et al. ..... 340/854.4
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 7/2005 Hall
2005/0161215 A1 7/2005 Hall
2005/0173128 A1 8/2005 Hall
2005/0212530 A1 9/2005 Hall
2005/0236160 A1 10/2005 Hall
2005/0284662 A1 12/2005 Hall

* cited by examiner

DOWNHOLE POWER GENERATION ASSEMBLY

BACKGROUND OF THE INVENTION

There has been a particular concern brought up in the last half a century of gaining access to data from a drill string. As exploration and drilling technology has improved, this goal has become more important in the industry for successful oil, gas, and geothermal well exploration and production. Vital information such as temperature, pressure, inclination, salinity, etc. would be of great benefit to those designing drilling components. Several attempts have been made to devise a successful system for accessing such drill string data. However, due to the complexity, expense, and unreliability of such systems, many attempts to create such a system have failed to achieve significant commercial acceptance.

This invention relates to oil and gas drilling, particularly to apparatus for reliably transmitting information between downhole drilling components.

U.S. Pat. No. 7,193,526 to Hall et al, which is herein incorporated by reference for all that is contains discloses a double shouldered downhole tool connection comprised of box and pin connections having mating threads intermediate mating primary and secondary shoulders. The connection further comprises a secondary shoulder component retained in the box connection intermediate a floating component and the primary shoulders. The secondary shoulder component and the pin connection cooperate to transfer a portion of makeup load to the box connection. The downhole tool may be selected from the group consisting of drill pipe, drill collars, production pipe, and reamers. The floating component may be selected from the group consisting of electronics modules, generators, gyroscopes, power sources, and stators. The secondary shoulder component may comprises an interface to the box connection selected from the group consisting of radial grooves, axial grooves, tapered grooves, radial protrusions, axial protrusions, tapered protrusions, shoulders, and threads.

U.S. Pat. No. 7,190,084 to Hall et al, which is herein incorporated by reference for all that is contains discloses a method and apparatus that uses the flow of drilling fluid to generate electrical energy in a downhole environment. A substantially cylindrical housing comprises a wall having an inlet, an outlet, and a hollow passageway therebetween. A flow of drilling fluid through the hollow passageway actuates a generator located therein, such that the generator generates electricity to power downhole tools, sensors, and networks. The miniaturization of the generator within the housing wall facilitates an unobstructed flow of drilling fluid through the central borehole of a drill string, while allowing for the introduction of tools and other equipment therein.

U.S. Pat. No. 5,839,508 to Tubel et al, which is herein incorporated by reference for all that is contains discloses an electrical generating apparatus which connects to the production tubing. In a preferred embodiment, this apparatus includes a housing having a primary flow passageway in communication with the production tubing. The housing also includes a laterally displaced side passageway communicating with the primary flow passageway such that production fluid passes upwardly towards the surface through the primary and side passageways. A flow diverter may be positioned in the housing to divert a variable amount of production fluid from the production tubing and into the side passageway. In accordance with an important feature of this invention, an electrical generator is located at least partially in or along the side passageway. The electrical generator generates electricity through the interaction of the flowing production fluid.

U.S. Pat. No. 3,867,655 to Stengel et al, which is herein incorporated by reference for all that is contains discloses an invention relating to an energy conversion device which may be selectively operated in the pump mode for converting electrical energy into fluid energy or in the generator mode for converting fluid energy into electrical energy. The improved device has a hollow toroidal body with a central axis on which are located opposed inlet and outlet openings. Enclosed in the body on the central axis between the openings are a coil circle, a rotatable circular rotor having an impeller with a number of radial blades fixed thereto, and a fixed circular diffuser having a number of spaced radial vanes secured thereto. The coil circle is formed of a number of electromagnetic coils which are connected to an electrical power supply in the pump mode to produce a travelling electromagnetic wave which rotates about the central axis and cuts radial spokes of the rotor. The fluid flow path through the device in either mode begins with an axial portion. Then a radial outward portion, a radial inward portion, and ends with a second axial portion along the same axis as the first axial portion. The components of the device are formed to provide that the radial portions of the flow path are substantially semicircular wherein the efficiency of the device is substantially constant over a wide range of variations in speed and capacity.

U.S. Pat. No. 6,848,503 to Schultz et al, which is herein incorporated by reference for all that is contains discloses a power generating system for a downhole operation having production tubing in a wellbore including a magnetized rotation member coupled to the wellbore within the production tubing, the rotation member having a passageway through which objects, such as tools, may be passed within the production tubing. Support braces couple the rotation member to the production tubing and allow the rotation member to rotate within the production tubing. Magnetic pickups are predisposed about the rotation member within the wellbore and a power conditioner is provided to receive currents from the magnetic pickups for storage and future use. The rotation member rotates due to the flow of fluid, such as crude oil, through the production tubing which causes the rotation member to rotate and induce a magnetic field on the magnetic pickups such that electrical energy is transmitted to the power conditioner, the power conditioner able to store, rectify, and deliver power to any one of several electronic components within the wellbore.

BRIEF SUMMARY OF THE INVENTION

In one aspect of the invention, a downhole power generation assembly has a downhole tool string component comprising a bore. A collar is rotatably supported within the bore and has a centralized fluid passageway and a plurality of fluid engaging blades. The collar is connected to a power generation element such that rotation of the collar moves the power generation element and induces an electrical current.

In some embodiments, an end of the collar may be connected to a second collar comprising the power generation element. The power generation element may be a magnet or a coil. The power generation element may be attached directly to the collar. The power generation element may be a magnet adapted to induce a current in a coil disposed proximate the collar where the magnet moves. The bore of the collar may narrow 61 proximate an end of the collar. The fluid engaging blades may be attached to an outer surface of the collar. In another embodiment, the fluid engaging blades may be attached within the centralized fluid passageway. The collar may comprise at least one perforation connecting the outer surface to the centralized fluid passageway. The perforation may be a slot angled with respect to a central axis of the downhole tool string component. The perforation may be adapted to allow fluid to be sucked into the centralized fluid passageway. The bore proximate the collar may increase in diameter. The centralized fluid passageway may be flush with a primary diameter of the downhole tool string component. The collar may be rotatably supported within the bore through a plurality of bearings. At least one of the bearings may be rotatably supported by an axel. At least one of the axels may form an angle with a central axis of the downhole tool string component. The collar may be substantially coaxial with a central axis of the downhole tool string component. The power generation element may be in communication with a battery. The power generation element may be in communication with an electronic device. The downhole tool string component may comprise a communication coupler proximate an end of the downhole tool string component and in electrical communication with the power generation element.

DETAILED DESCRIPTION OF THE INVENTION AND THE PREFERRED EMBODIMENT

Figure 1:
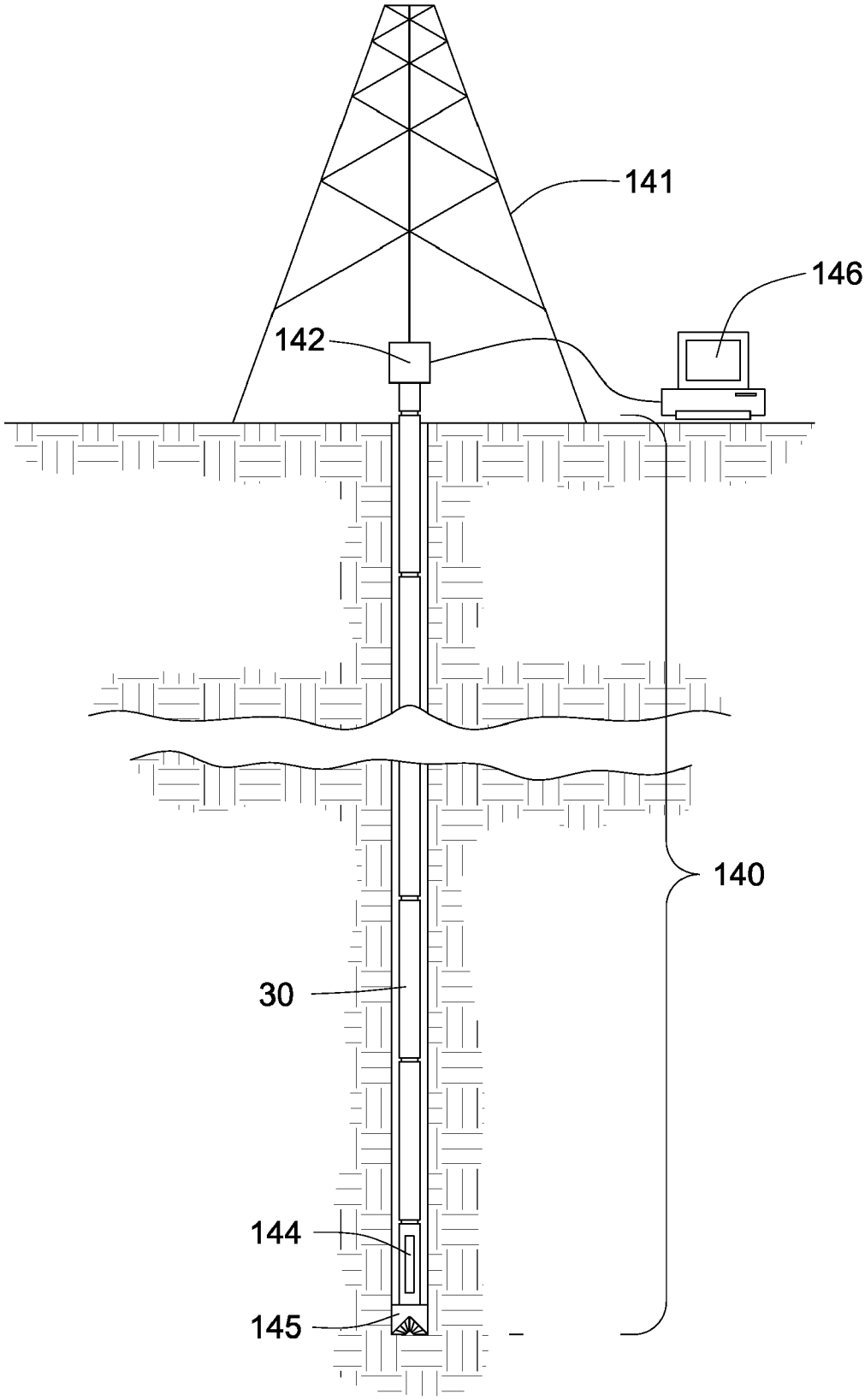
FIG. 1 is a perspective view of a drill string suspended in a bore hole.

FIG. 1 shows a drill string 140 suspended by a derrick 141. A bottom-hole assembly 144 is located at the bottom of a bore hole and comprises a drill bit 145. As the drill bit 145 rotates downhole the drill string 140 advance further into the earth. The bottom-hole assembly 144 and/or downhole tools 30, such as drill pipes, may comprise data acquisition devices (not shown) which may gather data. The data may be sent to the surface via a transmission system to a data swivel 142. The data swivel 142 may send the data to the surface equipment 146. Further, the surface equipment 146 may send data and/or power to downhole tools 30 and/or the bottom-hole assembly 144. In some embodiments of the invention, the downhole tool string does not incorporate a downhole telemetry system connecting the downhole tools to surface equipment.

Figure 2:
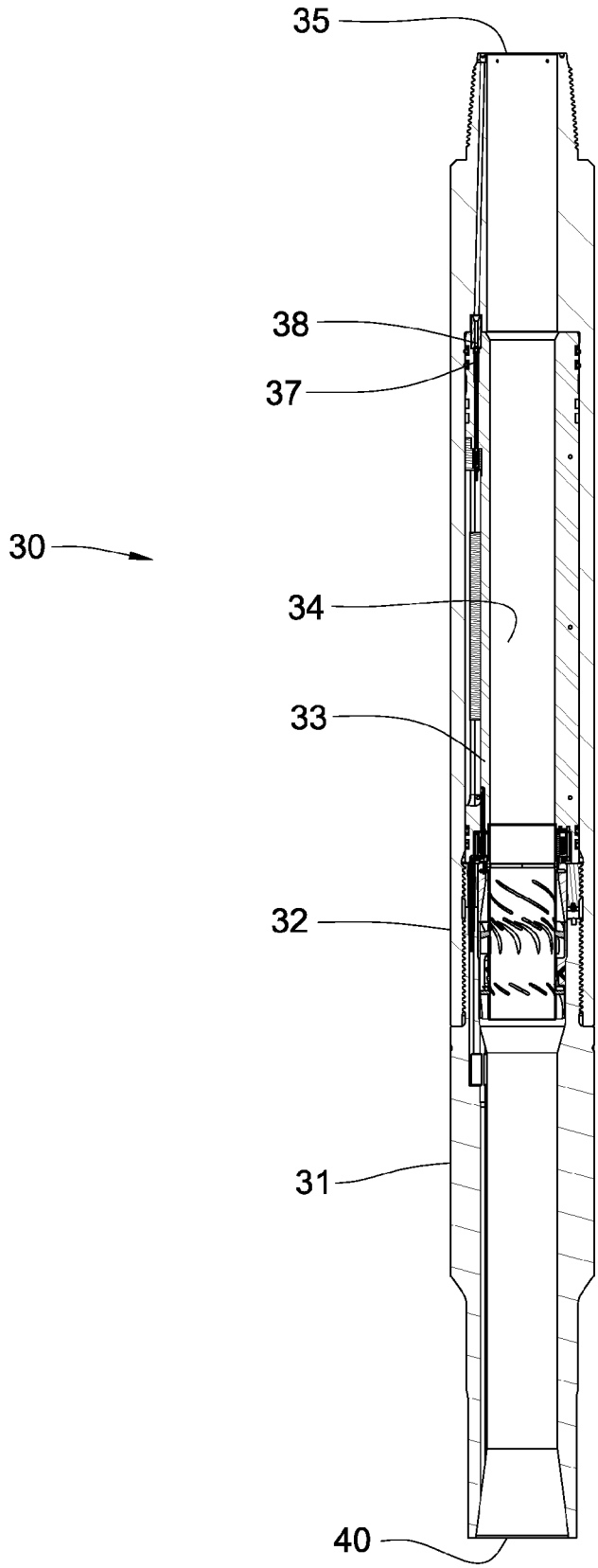
FIG. 2 is a cross sectional view of a downhole tool comprising a floating component.

FIG. 2 is a cross sectional view of a downhole tool 30 comprising a box connection 32 and a pin connection 31. Box connection 32 and pin connection 31 are located in a mid-body section of the downhole tool 30. The downhole tool 30 also comprises a box end 40 and a pin end 35 which are located at the ends of the downhole tool 30. The downhole tool 30 may be selected from the group consisting of drill pipe, drill collars, production pipe, heavy weight pipe, subs, jars, drill bits, reamers and combinations thereof. The box connection 31 of the downhole tool 30 comprises a receptacle 33. In the embodiment shown in FIG. 2, the receptacle is an expanded bore adapted to house a floating component 34 that may be selected from the group consisting of electronic modules, gyroscopes, generators, power sources and stators. Preferably, the floating component 34 is a hollow cylindrically shaped member with a pass through bore that is at least as large as the smallest bore of the tool joint. A downhole tool 30 that comprises a receptacle 33 for a floating component 34 maybe useful in downhole applications where equipment may be damaged by mechanical stresses normally experienced in a downhole tool string. A floating component may operate within the receptacle of the downhole component without experiencing normal downhole stresses.

Preferably the floating component 34 is adapted to communicate with a downhole network, such as a network as described in U.S. Ser. application Ser. No. 10/710,790 to Hall, et al. filed on Aug. 3, 2004, which is herein incorporated for all that it discloses. Suitable downhole tool strings adapted to incorporate data transmission systems are described in U.S. Pat. Nos. 6,670,880 to Hall, et al.; 6,641,434 to Boyle, et al.; and 6,688,396 to Floerke, et al. U.S. Pat. Nos. 6,670,880; 6,641,343; and 6,688,396 are all incorporated herein by reference for all that they disclose.

Figure 3:
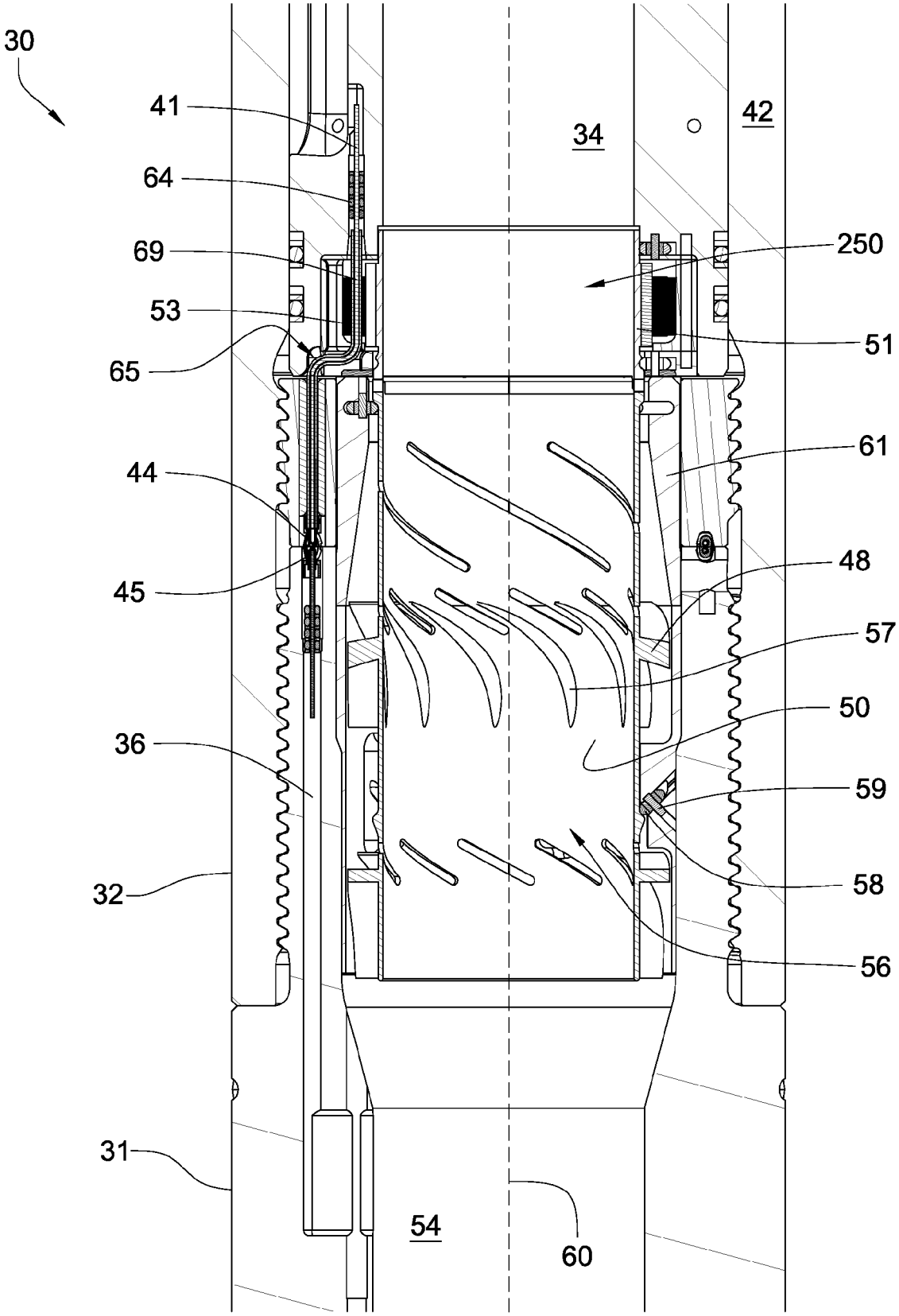
FIG. 3 is a cross sectional view of a downhole collar.

FIG. 3 is a cross sectional view of a downhole tool 30 connection. The pin connection 31 of the downhole tool 30 comprises a first conductor 36 intermediate the floating component 34 and an end 40 (shown in FIG. 2) of the downhole tool 30. The box connection 32 comprises a second conductor 41 intermediate the floating component 34 and another end 35 (shown in FIG. 2) of the downhole tool 30. The first and second conductor 36, 41 may be selected from the group consisting of coaxial cables, copper wires, optical fiber cables, triaxial cables, and twisted pairs of wire. The ends 35, 40 (shown in FIG. 2) of the downhole tool 30 are adapted to communicate with the rest of the downhole network. First and second communications elements 45, 44 allow the transfer of power and/or data between the first conductor 36 and the floating component 34. Third and fourth communications elements 37, 38 (shown in FIG. 2) allow for transfer of power and/or data between the floating component 34 and the second conductor 41. The communications element 37, 38, 44, 45, may be selected from the group consisting of inductive couplers, direct electrical contacts, optical couplers, and combinations thereof.

In some embodiments, the downhole tool 30 may complete an electric circuit as the return path between the first and/or second conductors 36, 41. In such embodiments the floating component 34 may need to be in electrical contact with the wall 42 of the downhole tool 30. During drilling and oil exploration, a drill string may bend creating a gap between the floating component 34 and the downhole tool's wall 42.

The cable may be routed through an inserted secondary shoulder of the tool connection. The inserted secondary shoulder may be proximate the floating element and the cable may pass through an interface between the floating element and the inserted secondary shoulder. In the embodiment shown in FIG. 3, the cable comprises two bends 65 approximately 90 degrees each which allows the cable to be routed through the inserted shoulder at a different radial location than it is routed through the floating element. A plurality of o-rings and back-ups may form a seal stack 64 which holds in downhole pressure and prevents fluid from leaking into the passages that house the cable. In some embodiments, communications elements, such as those described in U.S. Pat. No. 6,670,880 may be incorporated at the interface of the inserted shoulder and the floating. The communication elements may be biased to allow the elements to contact one another despite tolerance ranges and downhole vibrations.

A collar 50 rotationally isolated from the bore 54 of the tool string is rotationally supported within the bore 54. The bore 54 of the downhole tool string component may increase proximate the collar 50 to direct a portion of the fluid passing through the bore 54 of the tool string component to the outside surface of the collar 50. Fluid engaging blades 48 may be disposed on the outer diameter of the collar 50. A majority of the drilling fluid passes through a centralized fluid passage 56, while a portion of the drilling fluid will travel to the outside of the collar 50 and engage the blades 48 causing the collar 50 to rotate coaxially with a central axis 60 of the downhole tool 30. The drilling fluid that passes along the outside of the collar 50 may return to the inside diameter of the centralized fluid engaging surface through a plurality of perforations formed in the collar 50. It is believed that such perforations will cause the fluid to be sucked back into the inner diameter. Also a narrowing of the diameter proximate an end of the collar 50 may also help direct the fluid back into the centralized fluid passage.

Connected to the end of the collar 50 are a plurality of power generations elements, which as they rotate (induced by the rotation of the collar 50), they convert the rotation into electrical power. In some embodiments, the collar 50 may be connected to a second collar which houses the power generations elements. Preferably, the power generation elements are magnets which rotate along the inner diameter of the bore 54 of the tool string proximate a plurality of coils 53. The coils 53 may be in communication with batteries and or electrical devices which may be housed in the floating element.

The fluid engaging blades 48 may be turbine blades, impeller blades, or a combination thereof. In some embodiments, the blades may be curved to preferentially contact the fluid forcing the collar 50 to rotate. In other embodiments, the blades may be adapted to utilize lift from the passing of the drilling fluid as well as momentum from optimal venture exit locations. These may be located such that flow is biased preferentially over the top of the foil for additional Bernoulli lift. Slots may also be located at the base of the underside of the foil to impart momentum to the base of the foil for additional lift due to the flow changing directions upon exit. Special high-lift/low-drag hydrofoils may also employed to minimize drag and thereby encourage through flow and maximize lift. These may be high camber hydrofoils, so called "roof-top" foils and turbulent/boundary layer trip type foils. In some embodiments a combination of lift and contact of the drilling fluid may be used to optimize the collars rotation.

A plurality of bearing 58 may be mounted on the bore wall 42 which are adapted to rotationally support the collar 50 and in those embodiments which comprises a second collar 250, the bearing may be adapted to rotationally support the second collar as well. The bearing 58 may comprise a roller surface that rotates around an axel 59. In other embodiments roller bearings, ball bearings, plain bearings, bushings or combinations thereof may be utilize to rotationally support the collars or collars.

Preferably the centralized fluid passageway is at least as wide as the diameter of the bore 54 before the bore 54 is expanded proximate the collar 50. Such embodiments would allow the passage of darts, wipers, pigs, wireline tools, and combinations thereof.

Figure 4:
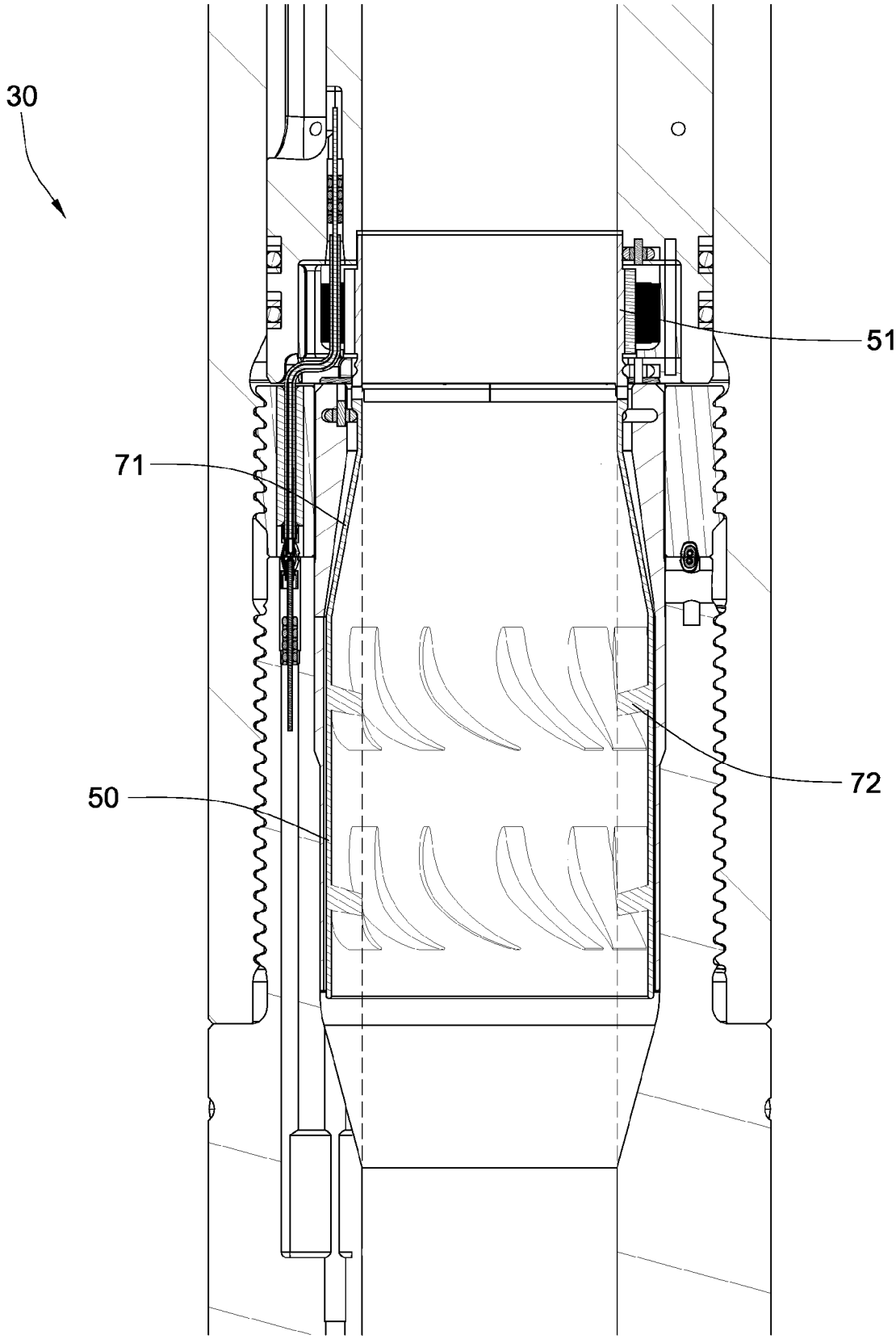
FIG. 4 is a cross sectional view of another embodiment of a downhole collar.

FIG. 4 discloses another embodiment of a downhole collar 50. A plurality of fluid engaging blades 72 may be disposed on the inside diameter 71 of the centralized fluid passage. In this embodiment the blades preferably do not intrude upon the diameter of tool string bore 54 before the diameter expansion proximate the collar 50. In such embodiments, wireline tools, darts, pigs, and wipers may easier pass through the centralized fluid passage.

Figure 5:
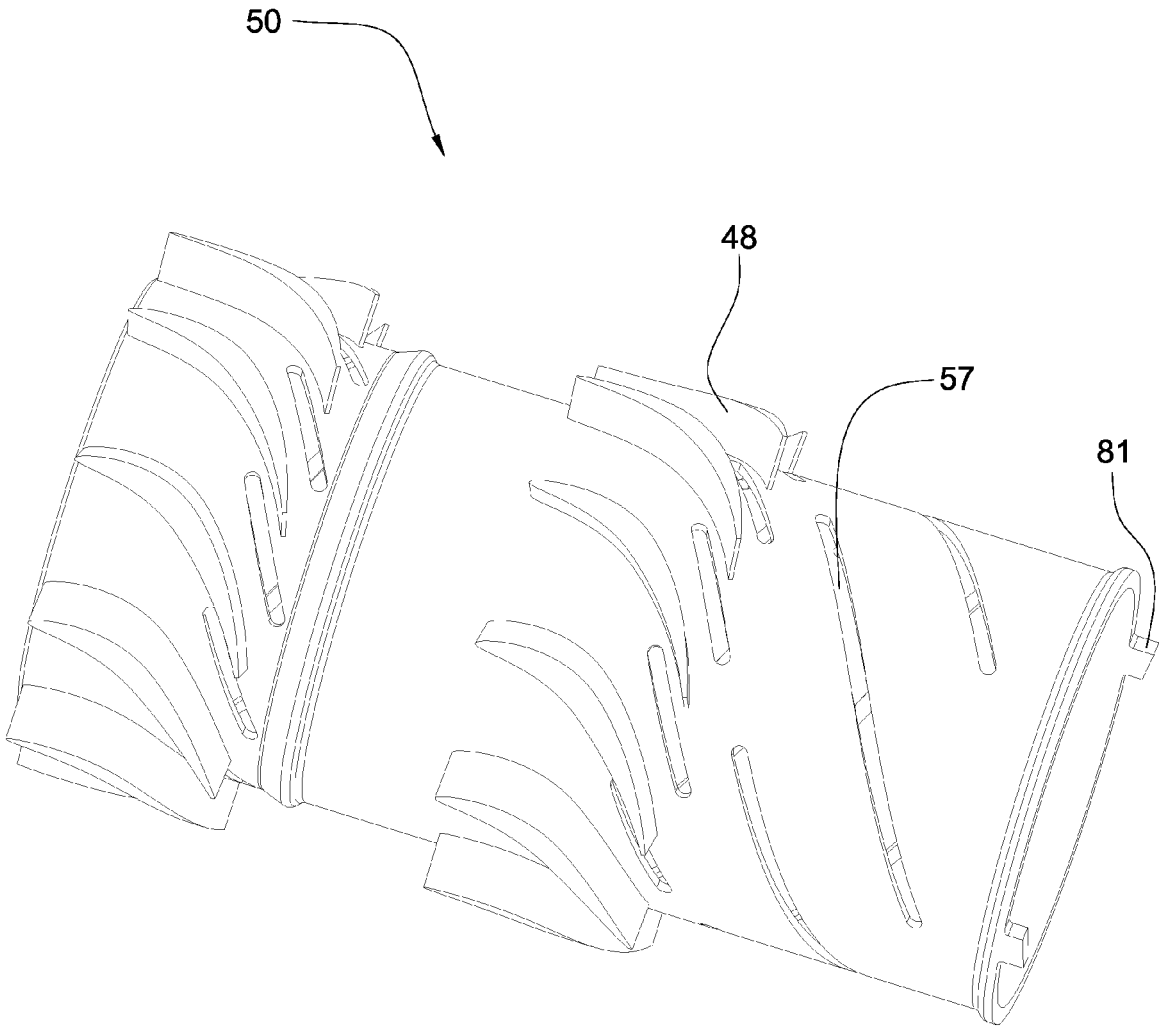
FIG. 5 is a perspective view of an embodiment of a collar.

FIG. 5 is a perspective view of an embodiment of a collar 50. Perforations 57 may be disposed on the outer surface of the collar 50 and may be angled with respect to the axis of the downhole tool 30 (shown in FIG. 2) component. Tabs 81 may be disposed on the circumferential edge of the collar 50 to lock the collar 50 into second collar 250 which houses the power generation elements 51 (shown in FIG. 3). These tabs may have a top surface set at a helix angle that is equal to, or larger than the pitch helix angle of the thread mating the two parts. This ensures clearance and avoids contact of the top surfaces during threading operations while allowing significant extrusion geometry thickness for torsional loads.

Figure 6A:
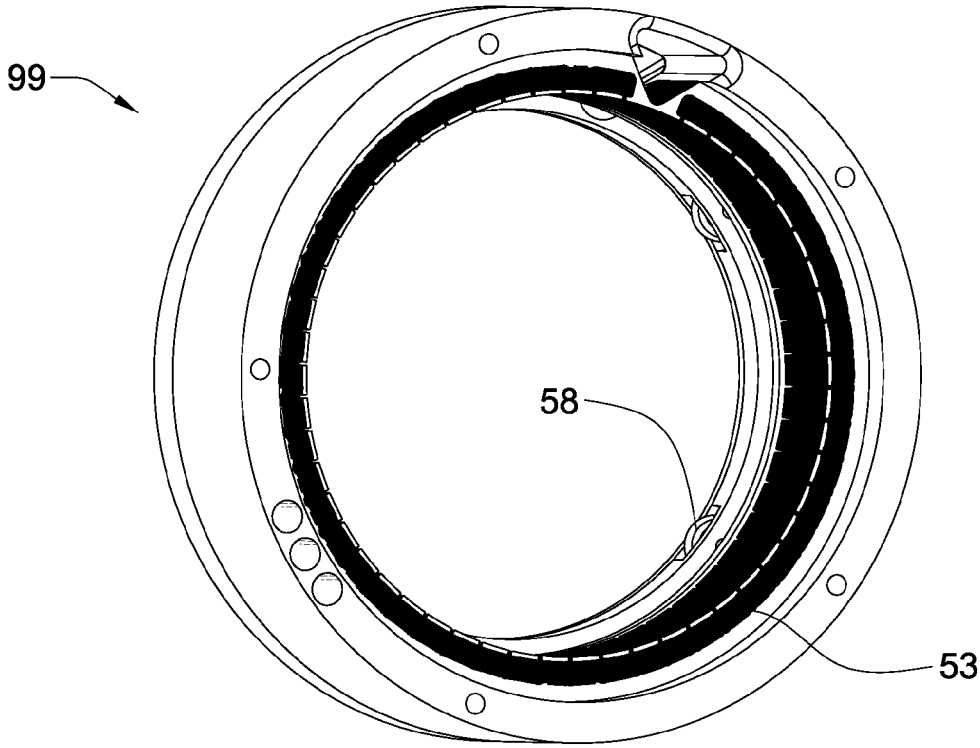
FIG. 6*a* is a perspective view of an embodiment of a power generation element.

FIG. 6*a* is a perspective view of an embodiment of an enclosure ring 99 which houses a plurality of coils 53 adapted to be substantially fixed to the bore 54 of the tool string component and allow magnets disposed within the second collar 250 to rotate with respect to them. In some embodiments, the enclosure ring may also rotate with respect to the tool string component bore 54 and also the power generation elements. The inner diameter of the power generation element enclosure ring 99 may comprise at least one bearing 58 to rotationally support the collar 50 or the second collar 250. Ports connected to the coils 53 and adapted to insertion of an electrically conductive medium are disposed in the enclosure. The electrically conductive medium may direct the generated electrically power to batteries or electrical devices. A V-shaped notch is also disposed within the enclosure ring adapted to accommodate the cable connecting the communications elements.

Figure 6B:
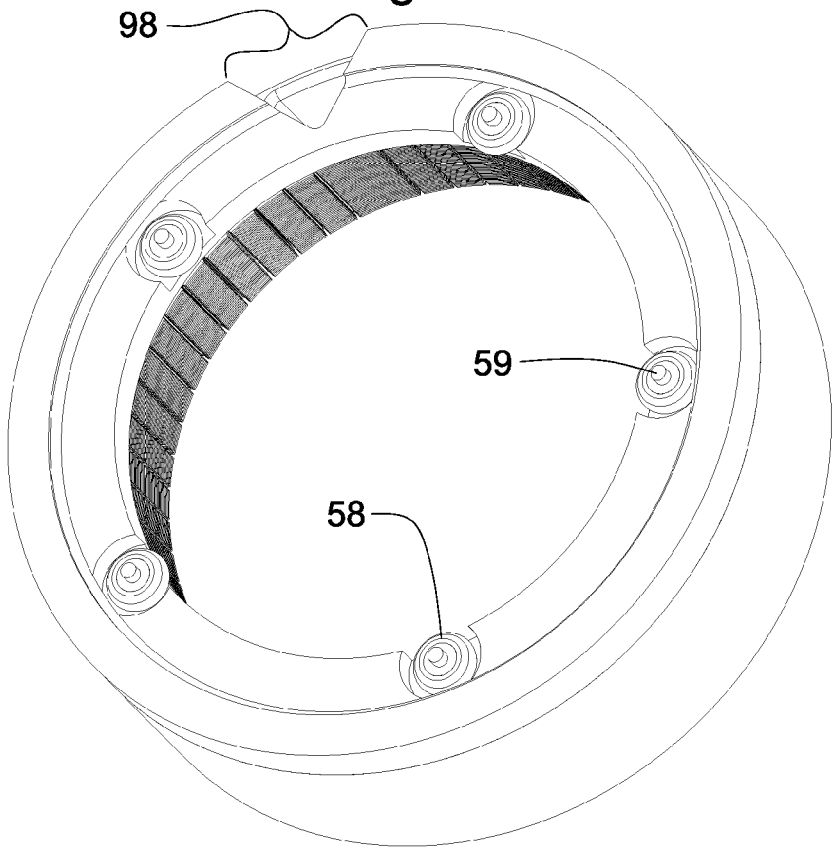
FIG. 6*b* is a perspective view of another embodiment of a power generation element.

FIG. 6*b* is another view of an embodiment of the enclosure ring 99. The bearings 58 disposed on the inner diameter of the power generation element enclosure ring 99 may be supported by an axel 59. The power generation element enclosure ring may comprise a notch 98 adapted to house electrical transmission cable 69.

Figure 7:
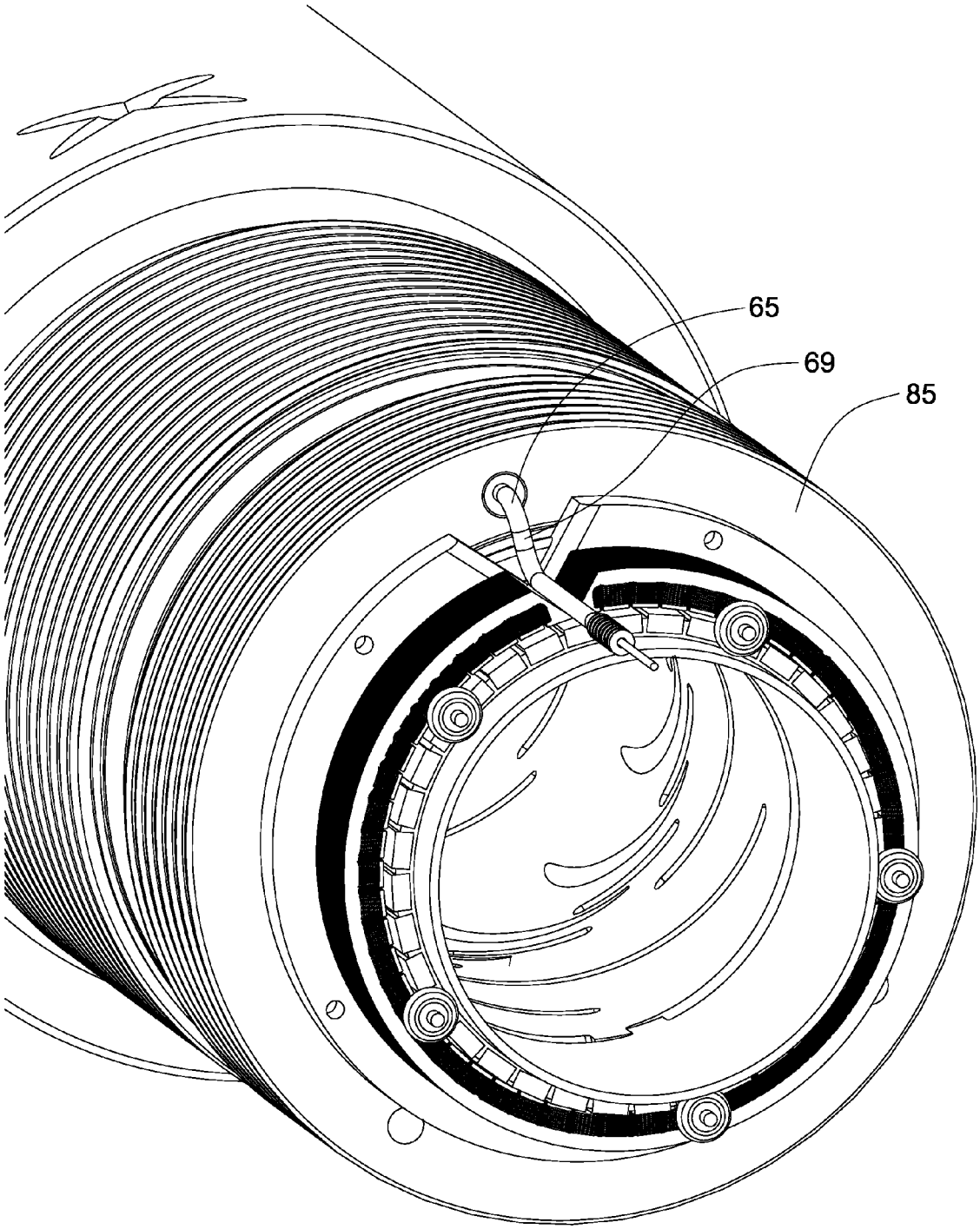
FIG. 7 is a perspective view of an embodiment of an electrical transmission cable passing through an inserted secondary shoulder of a box end.
Figure 8:
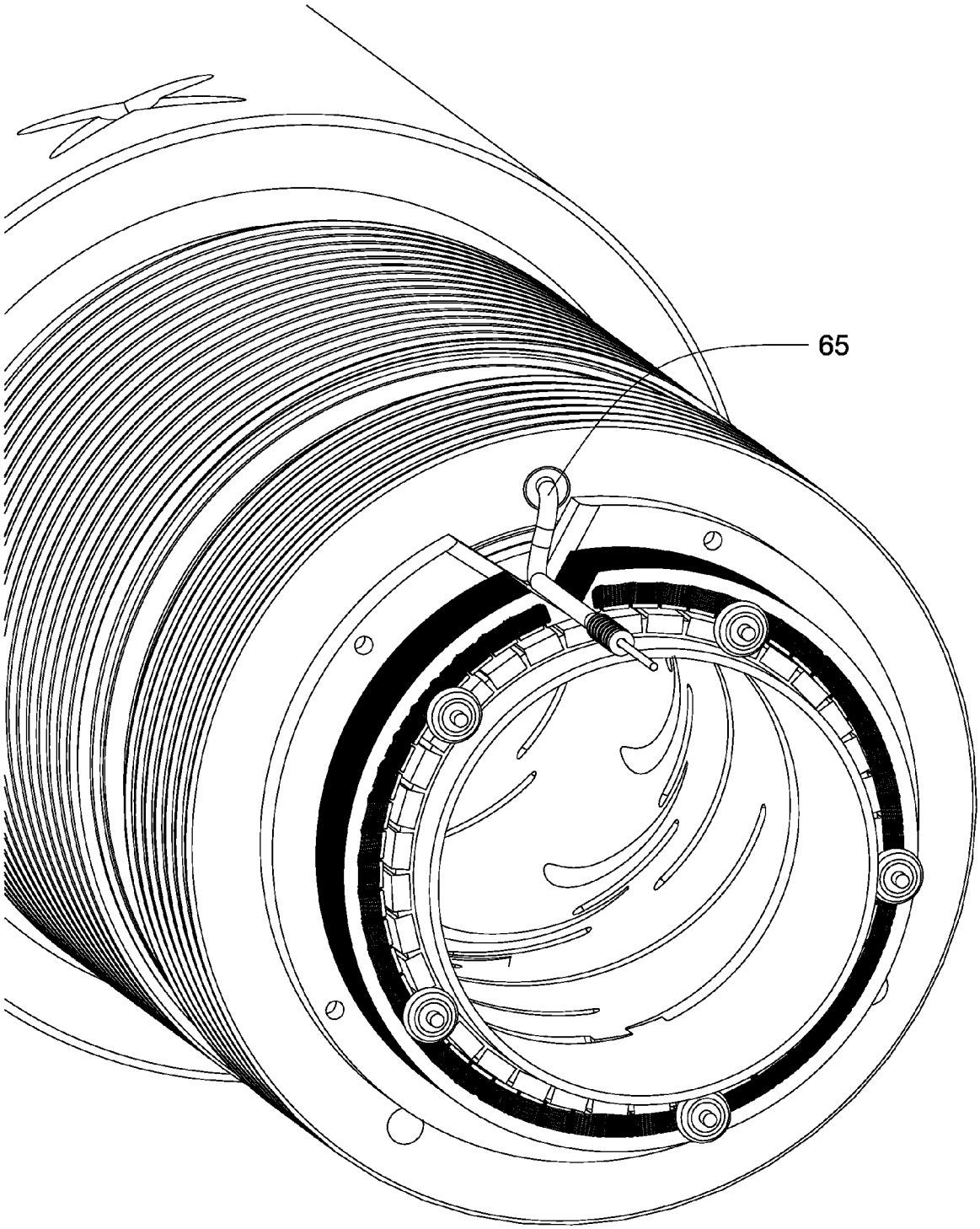
FIG. 8 is a perspective view of another embodiment of an electrical transmission cable passing through an inserted secondary shoulder of a box end.

FIGS. 7 and 8 are perspective views of embodiments of an electrical transmission cable 69 passing through an inserted secondary shoulder 85 in the notch. The floating element and the inserted shoulder may rotate with respect to one another during thread assembly due to massive makeup torque. This rotation may not be prevented mechanically in some configurations due to mechanical limitations. These two parts may rotate a fixed maximum based on the tread pitch, and contact preload length. By allowing these two parts to rotate relative to each other this amount, the two parts may be mated such that full connectivity may be achieved. A benefit of the bends 65 in the cable are illustrated in these figures since the bends allow the cable to rotate as the floating element and inserted shoulder rotate with respect to one another without shearing the cable. FIG. 7 depicts a first position while FIG. 8 depicts a rotated position. In some embodiments, a spring mechanism or a biasing mechanism may be used to return the cable to its first position after it has rotated.

Whereas the present invention has been described in particular relation to the drawings attached hereto, it should be understood that other and further modifications apart from those shown or suggested herein, may be made within the scope and spirit of the present invention.

What is claimed is:

1. A downhole power generation assembly, comprising:

a downhole tool string component comprising a bore;

a first collar rotatably supported within the bore and comprising a centralized fluid passageway and a plurality of fluid engaging blades;

the first collar being connected to a power generation element such that rotation of the first collar moves the power generation element and induces an electrical current;

wherein an end of the first collar is connected to a second collar comprising the power generation element.

2. The assembly of claim 1, wherein the power generation element is a magnet or a coil.

3. The assembly of claim 1, wherein the power generation element is attached directly to the second collar.

4. The assembly of claim 1, wherein the power generation element is a magnet adapted to induce a current in a coil disposed proximate the first collar where the magnet moves.

5. The assembly of claim 1, wherein the bore of the first collar narrows proximate an end of the first collar.

6. The assembly of claim 1, wherein the fluid engaging blades are attached to an outer surface of the first collar.

7. The assembly of claim 1, wherein the fluid engaging blades are attached within the centralized fluid passageway.

8. The assembly of claim 1, wherein the first collar comprises at least one perforation connecting the outer surface to the centralized fluid passageway.

9. The assembly of claim 8, wherein the perforation is a slot angled with respect to a central axis of the downhole tool string component.

10. The assembly of claim 8, wherein the perforation is adapted to allow fluid to be sucked into the centralized fluid passageway.

11. The assembly of claim 1, wherein the bore proximate the first collar increases in diameter.

12. The assembly of claim 1, wherein the centralized fluid passageway is flush with a primary diameter of the downhole tool string component.

13. The assembly of claim 1, wherein the first collar is rotatably supported within the bore through a plurality of bearings.

14. The assembly of claim 13, wherein at least one of the bearings is rotatably supported by an axel.

15. The assembly of claim 14, wherein at least one of the axels forms an angle with a central axis of the downhole tool string component.

16. The assembly of claim 1, wherein the first collar is substantially coaxial with a central axis of the downhole tool string component.

17. The assembly of claim 1, wherein the power generation element is in communication with a battery.

18. The assembly of claim 1, wherein the power generation element is in communication with an electronic device.

19. The assembly of claim 1, wherein the downhole tool string component comprises a communication coupler proximate an end of the downhole tool string component and in electrical communication with the power generation element.

* * * * *